US008320787B2

(12) United States Patent
Hosoi

(10) Patent No.: US 8,320,787 B2
(45) Date of Patent: Nov. 27, 2012

(54) IMAGE FORMING APPARATUS WITH PLURAL SHEET SUPPLYING SECTIONS

(75) Inventor: Kenichi Hosoi, Kawaguchi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 144 days.

(21) Appl. No.: 12/829,596

(22) Filed: Jul. 2, 2010

(65) Prior Publication Data

US 2011/0013924 A1 Jan. 20, 2011

(30) Foreign Application Priority Data

Jul. 16, 2009 (JP) ..... 2009-167595

(51) Int. Cl.
*G03G 15/00* (2006.01)
*G03G 21/20* (2006.01)

(52) U.S. Cl. ..... 399/81; 399/43; 399/82; 399/97

(58) Field of Classification Search ..... 399/81, 399/82, 83, 38, 43, 45, 49, 75, 76, 77, 97, 399/391

See application file for complete search history.

(56) References Cited

U.S. PATENT DOCUMENTS

| | | | | |
|---|---|---|---|---|
| 7,700,895 | B2 * | 4/2010 | Komatsu et al. | 399/97 X |
| 2004/0218197 | A1 | 11/2004 | Vliembergen et al. | |
| 2010/0034550 | A1 * | 2/2010 | Arai et al. | 399/81 |
| 2010/0046977 | A1 * | 2/2010 | Inenaga et al. | 399/81 |
| 2010/0296830 | A1 * | 11/2010 | Kamata | 399/81 |

FOREIGN PATENT DOCUMENTS

JP 2004-348713 A 12/2004

* cited by examiner

*Primary Examiner* — Sophia S Chen

(74) *Attorney, Agent, or Firm* — Buchanan Ingersoll & Rooney PC

(57) ABSTRACT

An image forming apparatus including: plural sheet supplying sections which accommodate a recording sheet and feed out the recording sheet; an image forming section which forms an image on the recording sheet, fed out from the sheet supplying section, based on a printing job; a memory section which stores information of the printing job, including information of the recording sheet; and a control section which determines a sheet supplying section, based on the information of the recording sheet, included in the printing job stored in the memory section, and displays an event using a time axis provided on a vertical axis or a horizontal axis on a display section, the event is generated by a schedule for using the sheet supplying section determined above, and is generated when the sheet supplying section is switched to another sheet-supplying section, or the event is generated at a predetermined time cycle.

9 Claims, 10 Drawing Sheets

IMAGE FORMING APPARATUS WITH PLURAL SHEET SUPPLYING SECTIONS

CROSS REFERENCE TO RELATED APPLICATION

This application is based on Japanese Patent Application No. 2009-167,595 filed on Jul. 16, 2009 with the Japanese Patent Office, the entire content of which is hereby incorporated by reference.

TECHNICAL FIELD

The present invention relates to an image forming apparatus which is configured to form images on a recording sheet.

BACKGROUND ART

In recent years, in working fields where printing operations are conducted by image forming apparatuses, the image forming apparatuses, combined with plural sheet supplying trays, are used so that the printing operations are conducted on various sizes and types of sheets. Accordingly, the operator must conduct various adjustments on the image forming apparatus, and supply the recording sheets to the apparatus. Further, since the operator sets plural printing adjustments on the apparatus, and applies the plural types of recording sheets to the apparatus, the operator can register a large number of printing sets.

In order to effectively conduct the printing operation according to the plan, before the operator starts the printing job, the operator is required to know which sheet supplying tray is to be used for the printing job, and the operator is also required to adjust the sheet supplying tray, and replenish the recording sheets.

In order to guide sheet supplying jobs to the operator, Unexamined Japanese Patent Application Publication 2004-348,713 discloses a printing system using a display unit on which a schedule for each printing job is displayed. The types of recording sheets accommodated in the sheet supplying trays are displayed on the vertical axis of a screen of the display unit, while working times and amount of recording sheets to be used are displayed on the horizontal axis of the screen of the display unit, whereby the working schedule can be displayed in a graph form.

SUMMARY OF THE INVENTION

In the working field of the printing job, there is a case to conduct a printing job, using a large number of recording sheets (being a large volume printing job). In this case, the recording sheets, accommodated on a single tray, are not enough to complete the printing job. To overcome this problem, plural trays and an automatic tray change are provided, so that a large volume printing job becomes possible on the working field. When the same types of recording sheets have been accommodated in the plural trays, if a tray becomes empty during the printing job, the empty tray is automatically switched to a new tray accommodating the recording sheets by the automatic tray change.

In the case of such large volume printing job, describe above, or in a case of plural printing jobs, information showing when a working tray is about to become empty is displayed on the display, further, a tray to be used next is shown on the display, by the above patent document. However, according to the above patent document, an interruption time due to various events is not taught, whereby time, when the operator has to replenish the recording sheets, cannot be precisely known beforehand, which can become a problem.

Item 1. An image forming apparatus reflecting one aspect of the present invention comprises: plural sheet-supplying sections which feed out a recording sheet, having been accommodated in it; an image forming section which forms images on the recording sheet, having been fed out, based on a printing job; a memory section which stores information of the printing job including at least information of the recording sheet to be used; and a control section which determines at least a sheet supplying section to be used, based on sheet information included in the printing job having been memorized in the memory section, and the control section displays an event while displaying a time on one of a vertical axis or a horizontal axis on a display section, wherein the event is generated by a schedule to use the sheet supplying section determined above, and is generated when the sheet supplying section to be used is switched to another sheet-supplying section, or the event is generated at a predetermined time cycle.

Item 2. The image forming apparatus of Item 1, wherein at least one of the sheet supplying sections includes a humidity sensor which detects humidity, and a heater to be controlled based on a detected result of the humidity sensor, wherein the event, to be generated when the sheet supplying section to be used is switched, is a preliminary operation to dehumidify the interior of the sheet supplying section by activating a heater, to be previously conducted before a sheet is fed from the switched sheet supplying section.

Item 3. The image forming apparatus of Item 1 or 2, further includes a fixing section including a heating section to be controlled to a predetermined temperature, wherein the event, to be generated when the sheet supplying section to be used is switched, is a preliminary operation of the fixing section to change the predetermined temperature.

Item 4. The image forming apparatus of one of Items 1-3, wherein at least one of the sheet supplying sections includes a sheet feeding section working as an air feeding method which vacuums up a sheet by a suction fan and feeds the sheet, wherein the event to be generated when the sheet supplying section to be used is switched, is a preliminary operation to stabilize a suction force of the suction fan, to be previously conducted before a sheet is fed from the switched sheet supplying section.

Item 5. The image forming apparatus of one of Items 1-4, wherein an image forming condition of the image forming section is changeable, wherein the event, generated at the predetermined time cycle, is an image density adjusting process to adjust the density of the image formed the image forming section at the predetermined time cycle.

Item 6. The image forming apparatus of one of Items 1-5, wherein the control section displays the event, generated when the sheet supplying section is changed, or the event, generated at the predetermined time cycle, on the display section, to identify the event.

Item 7. The image forming apparatus of one of Items 1-6, wherein a scale of the time axis displayed on the display section is changeable, wherein the control section controls a display to show the event or not, based on a size of the scale of the time axis to be displayed.

Item 8. The image forming apparatus of one of Items 1-7, wherein a display in which the time axis is used for one of the axis, and a display in which the number of sheets is applied on said axis, are changeable to be displayed, wherein when the display, on which the number of sheets is applied on the axis, is selected, the control section displays a generating time of the event, generated when the sheet supplying section is changed, based on a schedule to show a use of the sheet supplying section, or the control section displays a generating time of the event, generated at the predetermined time cycle.

Item 9. The image forming apparatus of one of Items 1-8, wherein the control section is possible to change the display not to display the generating time of the event, generated when the sheet supplying section is changed, and the control section makes is possible to change the display not to display the generating time of the event generated at the predetermined time cycle.

BRIEF DESCRIPTION OF THE DRAWINGS

Embodiments will now be detailed, by way of example only, with reference to the accompanying drawings which are meant to be exemplary, not limiting, and wherein like embodiments are numbered alike in the several figures, in which.

DETAILED DESCRIPTIONS OF THE PREFERRED EMBODIMENTS

Figure 1:
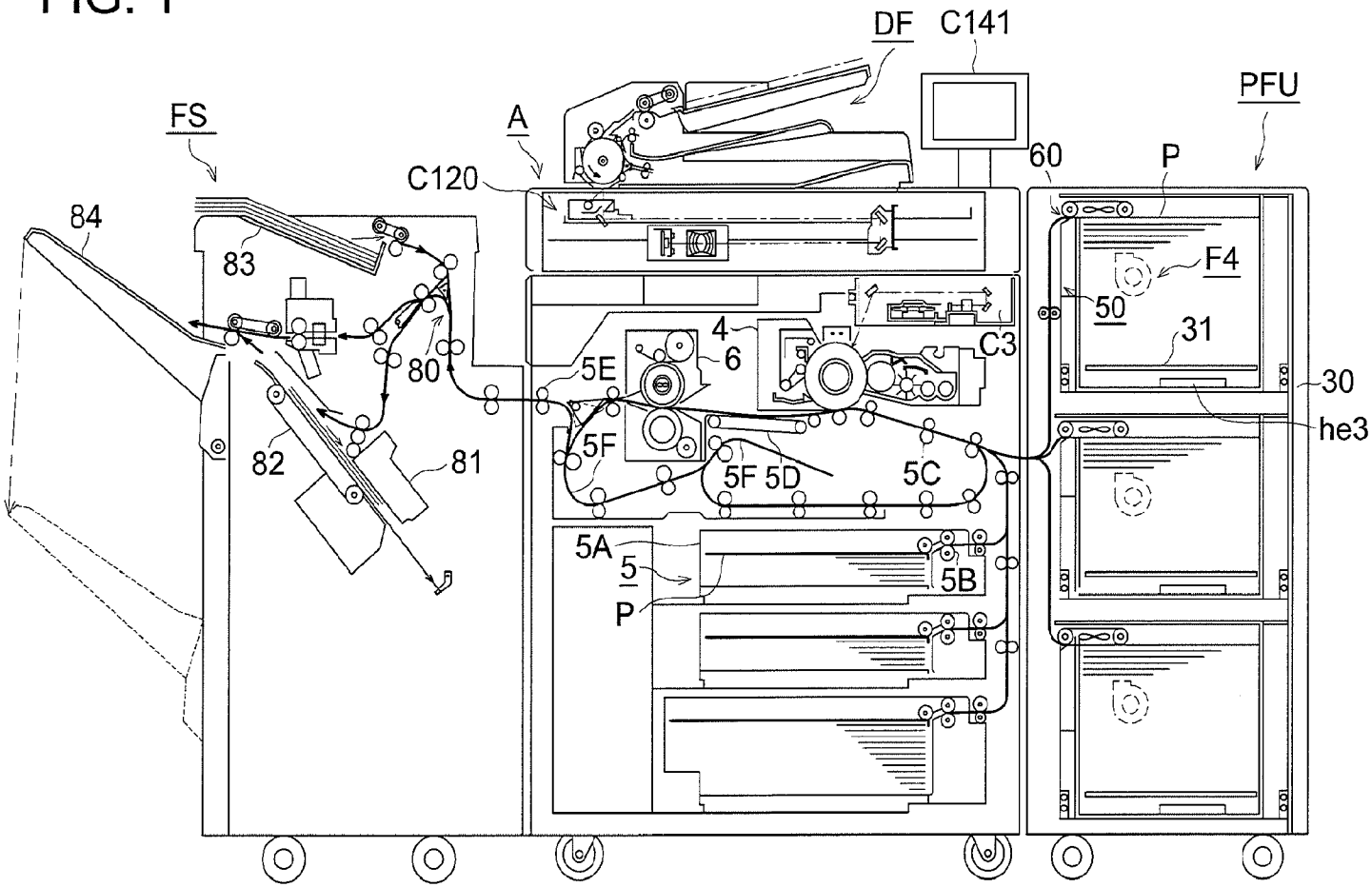
FIG. 1 is a frontal cross-sectional view, looking toward the front of an image forming system.

The present invention will now be detailed while referring to the drawings, however, the present invention is not limited to the embodiments detailed below.

FIG. 1 is a frontal cross-sectional view, looking toward the front of an image forming system. The image forming system includes image forming apparatus A, post finishing device FS, automatic document feeding device DF, and large capacity sheet supplying device PFU.

[Image Forming Apparatus]

Image forming apparatus A includes an image reading section, serving as scanner section C120, an image processing section, serving as total control Section C100, image writing section C3, image forming section 4, sheet feeding section 5, and fixing section 6.

Image forming section 4 is structured of photo conductive drum 41, electrical charging section 42, developing section 44, transfer section 45, sheet separation section 48, and cleaning section 47.

Sheet feeding section 5 includes plural sheet-supplying units 5A, first sheet supplying section 5B, second sheet supplying section 5C, feeding section 5D, sheet ejection section 5E, and automatic double-surface-copy sheet supplying section (ADU) 5F.

Operation display section C141, structured of an input section and a display section, and automatic document feeding section DF, are arranged on the upper portion of image forming apparatus A. Post finishing device FS is combined to sheet ejection section 5E of image forming apparatus A.

Images, carried on the front or reverse of an original document, when placed on the platen of automatic document feeding device DF, is read by an optical system of image reading section 1. Said image is photo-electrically converted to analog signals. The analog signals are processed via such as an analog process, A/D conversion, a shading correction, and an image compressing process. After that, the processed signals are sent to image writing section C3.

In image writing section C3, laser rays emitted from a semiconductor laser section are radiated onto photo sensitive drum 4A of image forming section 4, on which latent images are formed. In image forming section 4, various processes, such as electrical charging, exposure, development, transferring, sheet separation, and cleaning, are conducted. Detailed explanation will be shown later.

The images are transferred on recording sheet P, which has been fed by first sheet-supplying section 5B, by transfer section 4D. Recording sheet P, carrying the transferred images, is fixed by heat and pressure in fixing section 6, after that, said recording sheet P is fed to post finishing device FS through ejecting section 5E. Otherwise, recording sheet P, carrying the fixed images on the front surface, is fed to automatic double-surface-copy sheet supplying section 5F. After that, said sheet P receives images on the reverse surface at image forming section 4. Said recording sheet P, carrying the images on both surfaces, is then fed to post finishing device FS through ejection section 5E.

[Large Capacity Sheet Supplying Device PFU]

Large capacity sheet supplying device PFU, combined to image forming apparatus main body A, includes sheet supplying unit 30, first air blowing section 40, second air blowing section 50, and sheet feeding section 60, working by an air feeding method, whereby large capacity sheet supplying device PFU accommodates a large volume of recording sheets P, and feeds sheets P one by one to image forming apparatus main body A.

[Post Finishing Device FS]

Post finishing device FS includes insertion sheet supplying section 83 to accommodate inserted sheets (being used as front covers and reverse covers), stacking section 82, and stapling section 81, each vertically arranged in post finishing device FS.

Entrance feeding section 80 is provided on the upper right portion in FIG. 1 of post finishing section FS. Movable sheet-ejection tray 84, to receive and stack the printed sheets, is arranged on the upper left portion in FIG. 1 of post finishing section FS. Said movable sheet-ejection tray 84 can accommodate a maximum of 3,000 sheets carrying the printed images on A4 size and B5 size.

Figure 2:
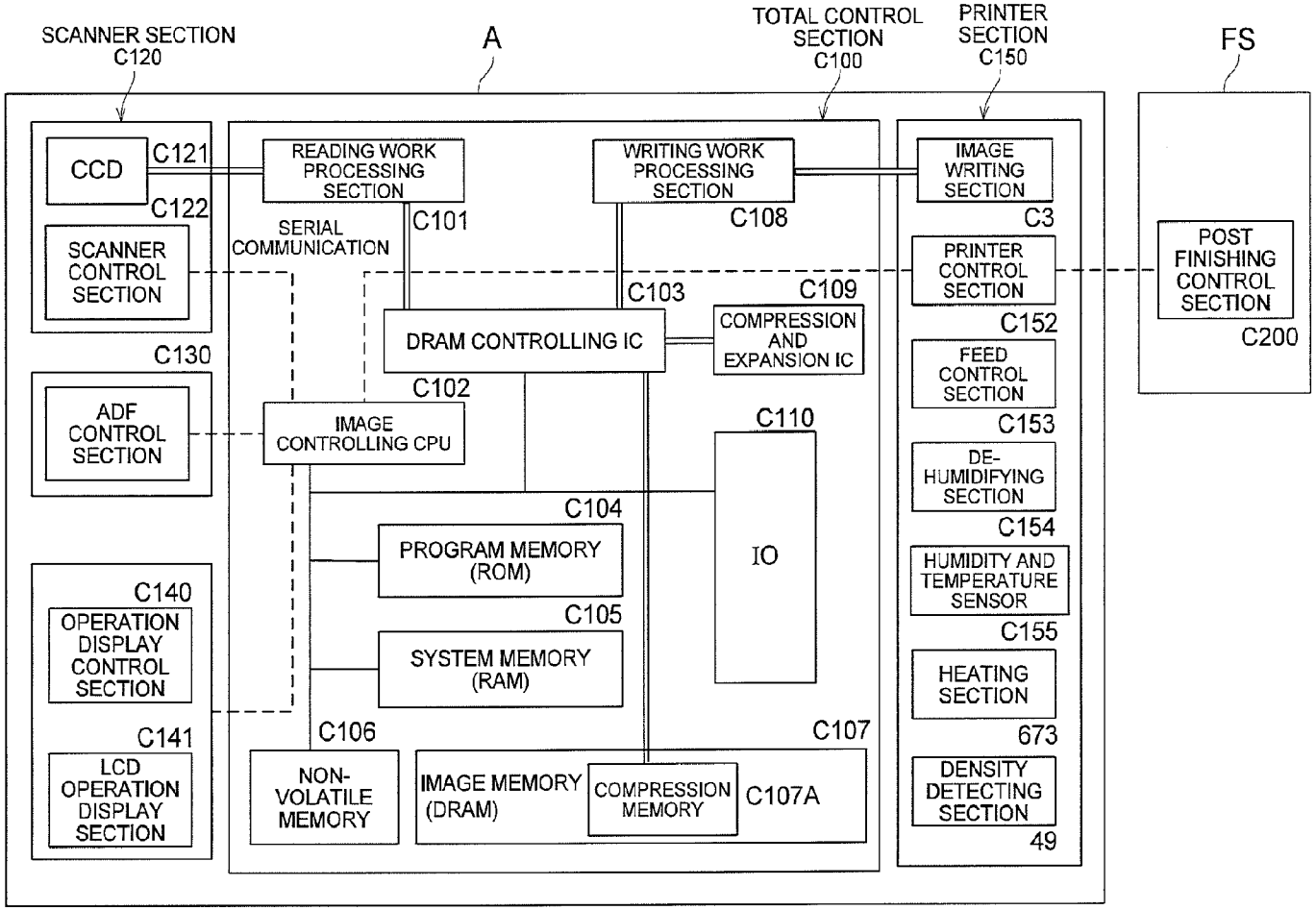
FIG. 2 is a block diagram of a control system of the image forming system.

FIG. 2 is a block diagram of the control system of the image forming system. Image forming apparatus A includes total control section C100, scanner section C120, ADF control section C130, operation display control section C140, and printer section C150.

Total control section C100 controls image forming apparatus A, and conducts the processing operations of the image data, and total control section C100 is structured of read-out processing section C101, DRAM controlling IC C103, image controlling CPU C102, program memory C104, system memory C105, non-volatile memory C106, writing processing section C108, compression/expansion IC C109, and input/output interface C110.

Read-out processing section C101 conducts various image processing operations, such as a variable power and graduation process, on the image data sent from scanner section C120. Image controlling CPU C102 conducts synchronization controls for scanner control section C122, ADF control section C130, and printer control section C152. DRAM control section C103 conducts writing and reading controls of the image data.

Program memory C104 is a ROM, storing control programs of image forming apparatus A and the image forming system. System memory C105 is a RAM for working operations.

Non-volatile memory C106 stores various parameters to be used for the control operations of various sections.

Image memory C107 memorizes the image data, and the printing jobs in which printing settings are included. Image memory C107 includes compression memory C107A.

Writing processing section C108 controls laser diode LD, which is an exposure light source of printer section C150. Interface C110 communicates with external devices such as personal computer PC.

Scanner section C120 includes CCD C121 which receives the original image and outputs its image signals, and scanner control section C122.

LCD operation display section C141 is structured of a liquid crystal display panel, and a touch panel, arranged to be overlapped on the liquid crystal.

Printer section C150 includes: image writing section C3 which writes images by laser diode LD, printer control section C152 which controls each section of image forming section 4 which forms images by the electro-photographic process, feed control section C153 which controls a drive motor which feeds the recording sheet, dehumidifying section C154 which dehumidifies the interior of sheet supplying unit 30, temperature and humidity sensor C155 which detects the temperature and humidity of the interior of sheet supplying unit 30, heating section 673 which heats fixing section 6, and density detecting section 49.

Post finishing device FS includes post finishing control section C200 which conducts a stapling process or the like as the post finishing operation.

[Dehumidifying Operation of the Interior of Sheet Supplying Unit 30]

Figure 3:
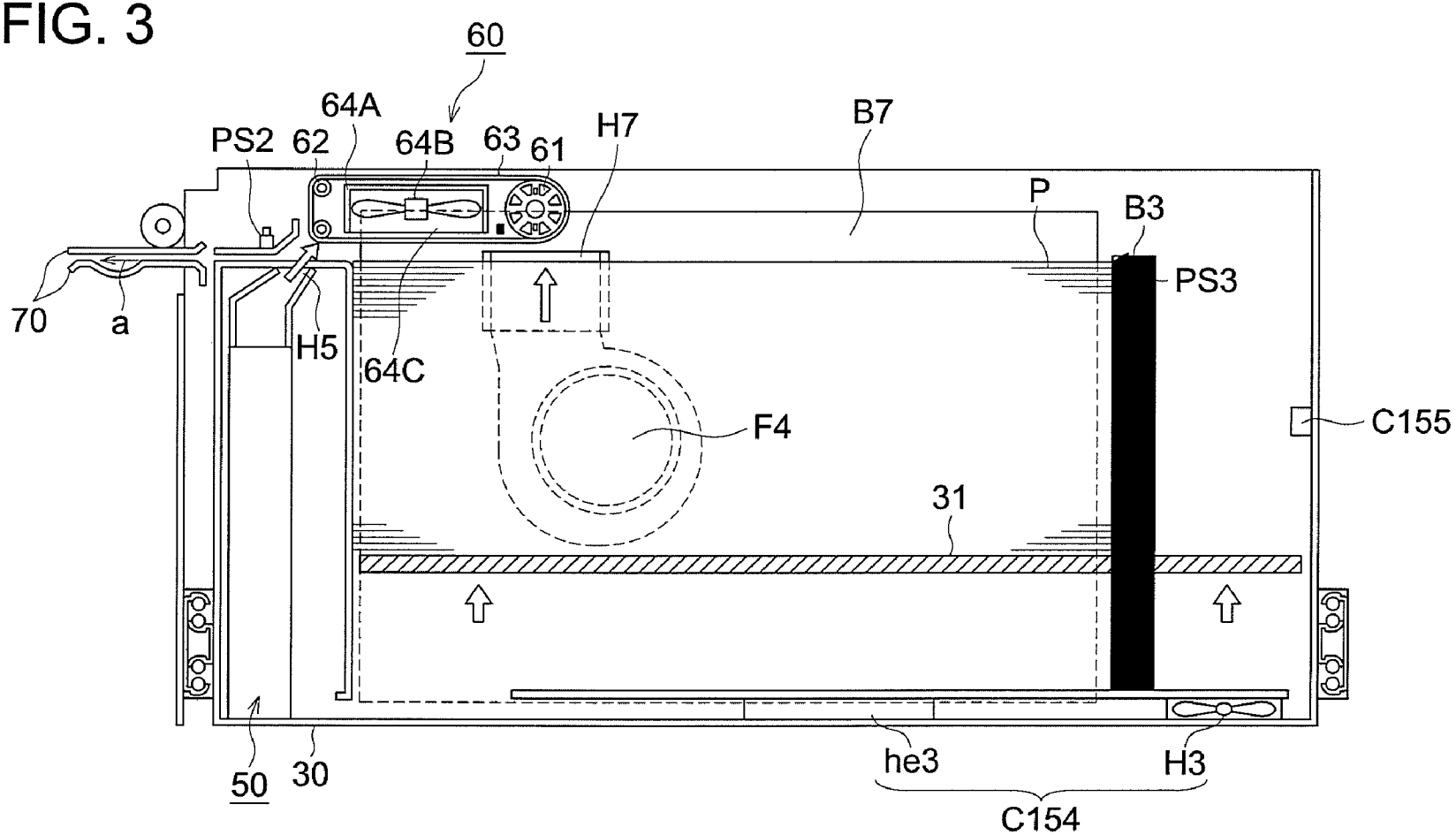
FIG. 3 is a frontal cross-sectional view, looking toward the front of sheet supplying unit 30.

FIG. 3 is a frontal sectional view of sheet supplying unit 30. The structure of sheet supplying unit 30, to be detailed in FIGS. 3 and 4, can be applicable in sheet supplying unit 5A. In the present invention, sheet supplying unit 30 and sheet supplying unit 5A are configured to function as sheet supplying sections.

Dehumidifying section C154 is provided in sheet supplying unit 30. Dehumidifying section C154 is structured of heater he3 and fan H3. The operation of dehumidifying section C154 is controlled by printer control section C152, to be detailed later, based on the relative humidity detected by temperature and humidity sensor C155. Heater he3 is activated to produce an increase in the temperature of the interior of sheet supplying unit 30, whereby the relative humidity of the interior of sheet supplying unit 30 decreases, that is, the dehumidifying operation for the interior is conducted, whereby sheets P, accommodated within the interior of sheet supplying unit 30, are dehumidified. Dehumidifying section C154 and humidity sensor C155 are arranged within plural sheet supplying units 30 and plural sheet supplying units 5A, respectively, so that the interior of each sheet supplying unit 30 and the interior of each sheet supplying unit 5A can be dehumidified independently.

Accordingly, the amount of time, required for the preliminary operation to dehumidify the interior of the sheet supplying section using the heater, which is previously conducted before the sheet supplying operation from sheet supplying unit 30, can be calculated based on the difference between the relative humidity at the starting time of the dehumidifying operation and the targeted relative humidity, and based on dehumidifying efficiency. For example, if under a condition that the humidity, detected by temperature and humidity sensor C155 at the starting time of the dehumidifying operation, is 65% RH, the targeted humidity is 50%, and the dehumidifying efficiency is 35 RH/min, the time required for the preliminary operation can be calculated as 15 minutes.

[Sheet Feeding Section Using Vacuum Feeding Method]

Figure 4:
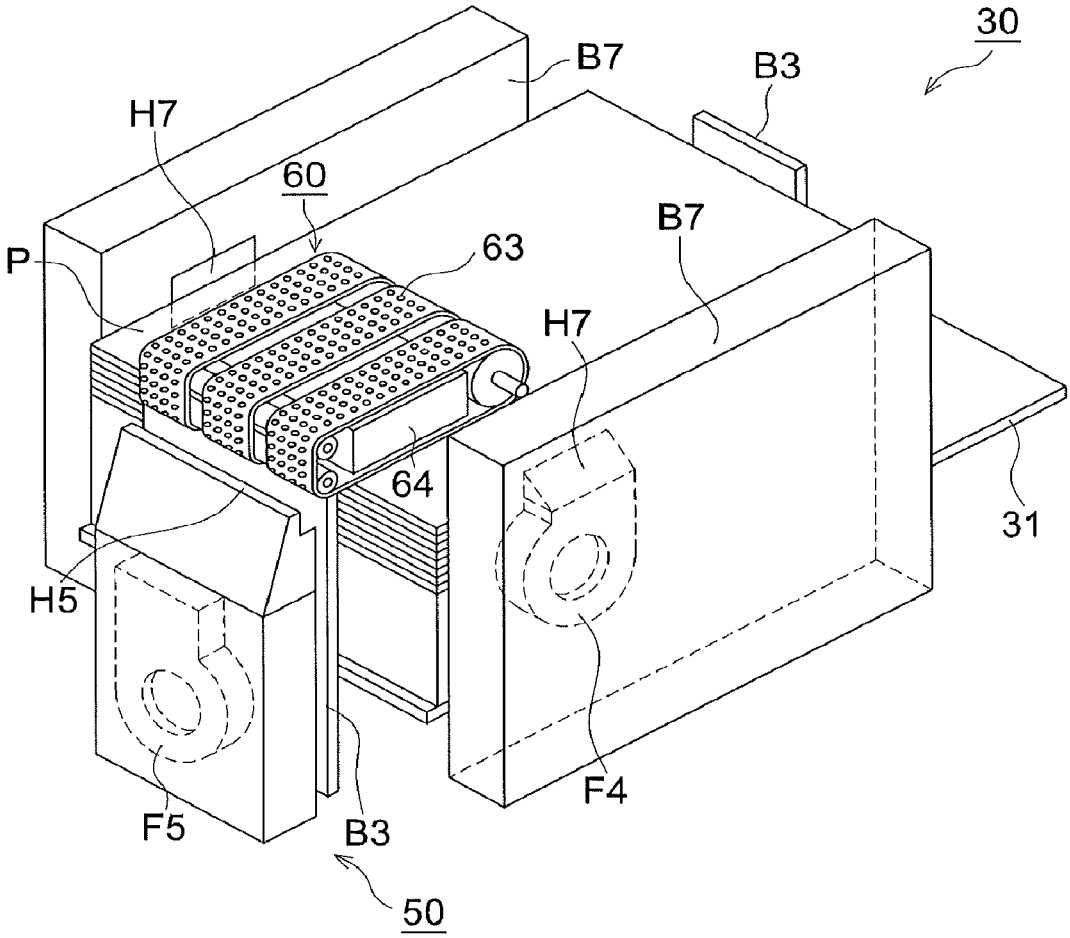
FIG. 4 is a perspective view of relevant parts of sheet supplying unit 30 shown in FIG. 3.

Sheet feeding section 60 shown in FIG. 3 represents a sheet feeding section using a vacuum feeding method, and FIG. 4 is a perspective view of relevant parts of sheet supplying unit 30, shown in FIG. 3.

In FIGS. 3 and 4, sheets P are stacked on elevating plate 31, and said elevating plate 31 moves vertically. Paired lateral side aligning guides B7 are provided to align stacked sheets P, and moves perpendicular to the sheet feeding direction, so that the distance between paired lateral side aligning guides B7 is changeable, whereby various sizes of sheets P can be placed on elevating plate 31, while the central position of the widths of various sizes of sheets P are always constant.

Stacked sheets P are aligned by two aligning plates B3 in the sheet feeding direction, as shown in FIG. 4. Arrow "a" in FIG. 3 shows the sheet feeding direction. One of aligning plates B3 is positioned near air blowing fan F5, to align the leading edges of stacked sheets P, and said aligning plate B3 is fixed on sheet supplying unit 30, while the other aligning plate B3 is supported on sheet supplying unit 30, to be movable in the sheet feeding direction, which aligns the trailing edges of stacked sheets P. Further, lateral side aligning guides B7 and aligning plates B3 exhibit suitable heights and shapes to align recording sheets P, while said sheets P are floating, due to applied air, which will be detailed later.

Still further, in FIG. 3, height detector PS3 is mounted on aligning plate B3, to detect the height of uppermost sheet P of the stacked sheets. A motor, which is not illustrated, is driven to move elevating plate 31 upward, based on a result detected by height detector PS3, so that the uppermost sheet P is always positioned at a predetermined height.

Two air blowing fans F4 are mounted to blow air from air outlets H7. Air outlets H7 are arranged to blow air against the uppermost sheet P, while said sheet P is kept at the predetermined height by elevating plate 31. Uppermost and several sheets P are floated by the blown air against gravity. Air blowing is specifically effective on relatively heavy sheets. Since air outlets H7 are mounted on lateral side aligning guides B7, so that they can move integrally. Accordingly, even though the size of sheet P changes, outlets H7 can be arranged at the most suitable positions for the stacked sheets P.

In FIG. 3, sheet feeding section 60 is arranged at the downstream position in the sheet feeding direction. On sheet feeding section 60, three suction belts 63 are entrained about large roller 61 and two small rollers 62, and said belts 63 are arranged in the lateral direction of feeding sheet P.

A large number of small holes are arranged to penetrate suction belts 63, as shown in FIG. 4. Air duct 64A of suction section 64 is housed within suction belts 63.

Suction section 64 is structured of duct 64A and suction fan 64B. Under duct 64A, opening 64C is mounted to face suction belts 63. Opening 64C determines the air suctioning position of sheet feeding section 60. The suctioned air is ejected toward the back through duct 64A. Otherwise, suction fan 6413 can be mounted on the back of the device, to connect with sheet feeding section 60 by a duct.

In case that recording sheets P are continuously fed, suction fan 64B is always activated, so that sheet feeding section 60 vacuums recording sheets P one by one, being floated by the air blown through air outlet H7. A driving source is activated by a control section, to rotate suction belt 63 which will be detailed later, whereby recording sheet P is fed in arrowed direction "a", and is sent to image forming apparatus main body A.

Fan F5 is provided on a downstream position in sheet feeding direction "a", to blow air through air outlet H5. Even though several overlapped sheets P have been vacuumed onto suction belt 63, which is an overlapped feeding condition, said air separates sheets P other than the uppermost sheet P from suction belt 63, and the uppermost sheet P remains on suction belt 63.

Suction detecting sensor PS2, arranged adjacent to opening 64C of suction section 64, detects when uppermost sheet P has been vacuumed up. Feed sensor PS2 is arranged between sheet ejection guide 70 and suction belt 63, to detect sheet P passing under feed sensor PS2.

After fans F4 and 64B have been activated on sheet supplying unit 30, using the air feeding method, a warm-up time is necessary until the air flow is stabilized and air the pressure becomes effective. Sheet supplying unit 30 requires several seconds to ten and several seconds to stabilize. When sheet supplying units 30 are switched to select desired sheets, the warm-up time for obtaining effective rotation of each fan is necessary for the present system.

[Warm-Up Operation to be Conducted Due to the Changing Action of the Fixing Temperature]

Figure 5:
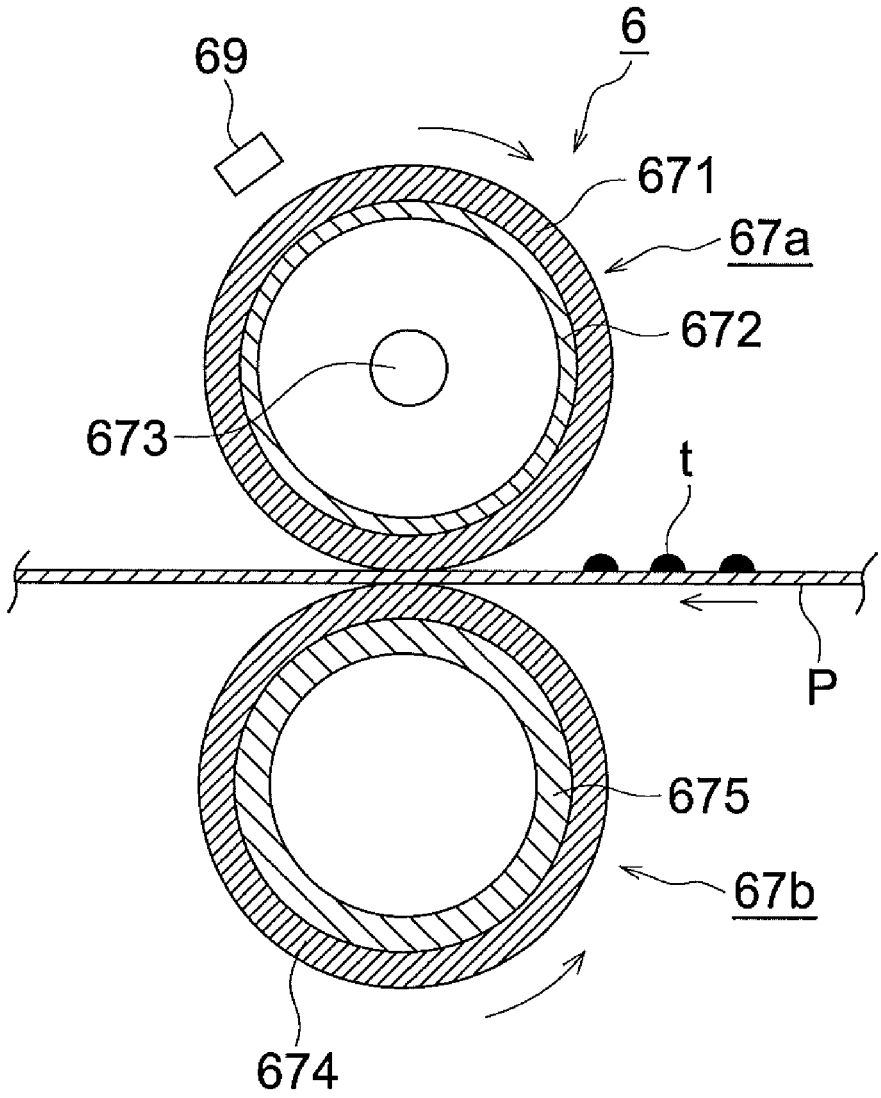
FIG. 5 is a cross-sectional view of fixing section 6.

FIG. 5 is a cross-sectional view of fixing section 6, showing heating roller 67*a*, and pressure applying roller 67*b* which is in pressure contact with heating roller 67*a*. In FIG. 5, "t" represents a toner image formed on sheet P. Said toner image "t" on sheet P is heated and pressured between heating roller 67*a* and pressure applying roller 67*b*, so that said image "t" is permanently fixed.

Heating roller 67*a* has cored bar 672 on which cover layer 671 is applied, and cover layer 671 is formed of a fluorine resin or an elastic member. Heating roller 67*a* further includes heating section 673, containing a halogen lamp as a heating source.

Pressure applying roller 67*b* has cored bar 675 on which elastic cover layer 674 is applied.

The contacting pressure between heating roller 67*a* and pressure applying roller 67*b* is normally 40N -350N, wherein 50N -300N is preferable, and 50N -250N is the more preferable pressure. Said contacting pressure is determined, based on the strength of heating roller 67*a*, that is, it is determined based on the radial thickness of cored bar 672. For example, less than 250N is preferable for a heating roller having the cored bar exhibiting a radial thickness of 0.3 mm.

The surface temperature of heating roller 67*a* is detected by temperature sensor 69. To keep the surface temperature of heating roller 67*a* at targeted preset temperatures, the electrical current is controlled for heating section 673.

TABLE 1

| SHEET | WEIGHT OF SHEET (G/M$^2$) | PRESET TEMPERATURE (° C.) | FIXING SPEED RATIO |
|---|---|---|---|
| Thin Sheet 1 | 40-49 | 160 | 1 |
| Thin Sheet 2 | 50-61 | 170 | 1 |
| Normal Sheet | 62-135 | 190 | 1 |
| Thick Sheet 1 | 136-209 | 190 | 2/3 |
| Thick Sheet 2 | 210-300 | 190 | 1/2 |

Table 1 is a correspondence table, in which the weight of sheet to be fixed, the preset temperature of heating roller 67*a*, and the fixing speed ratio correspond each to other. The fixing speed ratio represents a ratio, that is calculated between the feeding speed of sheets exhibiting various weights, and the feeding speed of the normal sheet (500 mm/sec, for example). The greater the weight of sheet increases, the higher the preset temperature is determined, and the lower the sheet feeding speed is determined. Accordingly, the greater the weight of the sheet increases, the greater heat is applied to the sheets.

The weight of sheets, accommodated in sheet supplying units 30 and 5A, can be preset by the operator through operation display section C141.

Due to the change of sheet supplying unit 30 (or 5A), if the preset temperature of heating roller 67*a* needs to be changed, the warm-up operation for fixing section 6 is necessary so that the temperature of heating roller 67*a* can reach the preset temperature. For the warm-up operation, each roller of fixing section 6 is rotated as an idling operation, or heating section 673 is electrically activated.

[Adjusting Operation of Image Density]

Figure 6:
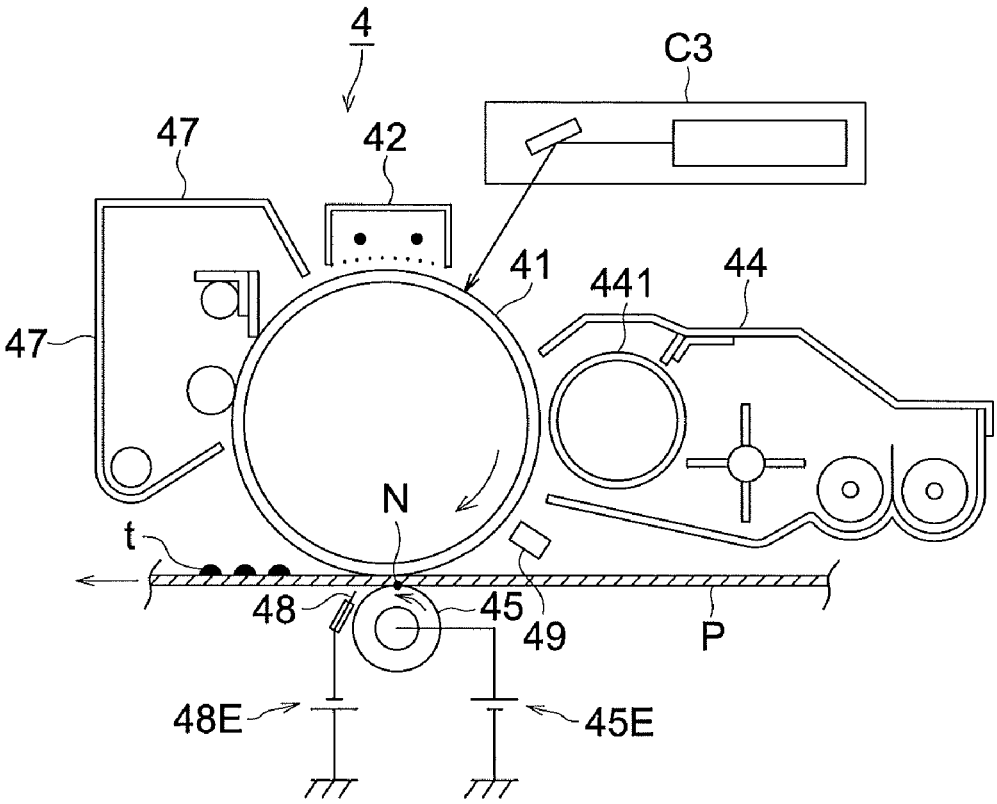
FIG. 6 is a cross-sectional view of image forming section 4.

FIG. 6 is a cross-sectional view of image forming section 4. Electrical charging section 42, image writing section C3, developing section 44, transfer roller 45, and cleaning section 47 are arranged around photoconductor 41, as the order of the image forming process.

After photoconductor 41 is charged by electrical charging section 42, exposure is conducted on photoconductor 41 by image writing section C3, based on the image data, so that a latent image is produced. Toner particles and magnetic carriers, serving as a dual component developer, are stored in developing section 44, which are agitated and circulated by a screw. Developing roller 441 has a fixed magnetic pole therein, and a sleeve, having a rotatable periphery surface. The alternating voltage, combined with the direct voltage, is applied on the sleeve. The developing agents are fed to the periphery of developing roller 441, and the thickness of said agents is controlled within a predetermined limit, whereby the developing agents develop the latent image formed on photoconductor 41.

Transfer roller 45 is formed of an electro-conductive elastic layer, being formed on the surface of a rotating shaft. Transfer voltage is applied on transfer roller 45 by power supply 45E. Photoconductor 41, facing transfer roller 45, is grounded.

Separation-electro-eliminating 48 is arranged on the downstream, in the feeding direction of the transfer member, of transfer nipping section N, transfer roller 45 and photoconductor 41 come into pressure contact with each other on said section N. Power supply 48E applies voltage exhibiting an opposite polar character against the transfer voltage applied on transfer roller 45.

Density detecting section 49 includes a light emitting element and a light receiving element. Density detecting section 49 measures the light amount reflected from a predetermined patch image formed on photoconductor 41, whereby the developing amount of toner (being an adhered amount of toner) is detected.

In an image density adjusting operation, the amount of exposure conducted by image writing section C3, developing bias output onto developing roller 441, and various image forming conditions are adjusted, based on detecting information from density detecting section 49, whereby the predetermined developing amount (being the image density) is obtained. The image density adjusting operation is conducted on a predetermined cycle. The predetermined cycle represents a predetermined number of sheets, for example 500 sheets, or a predetermined time interval, 120 minutes for example.

[Control Flow]

Figure 7:
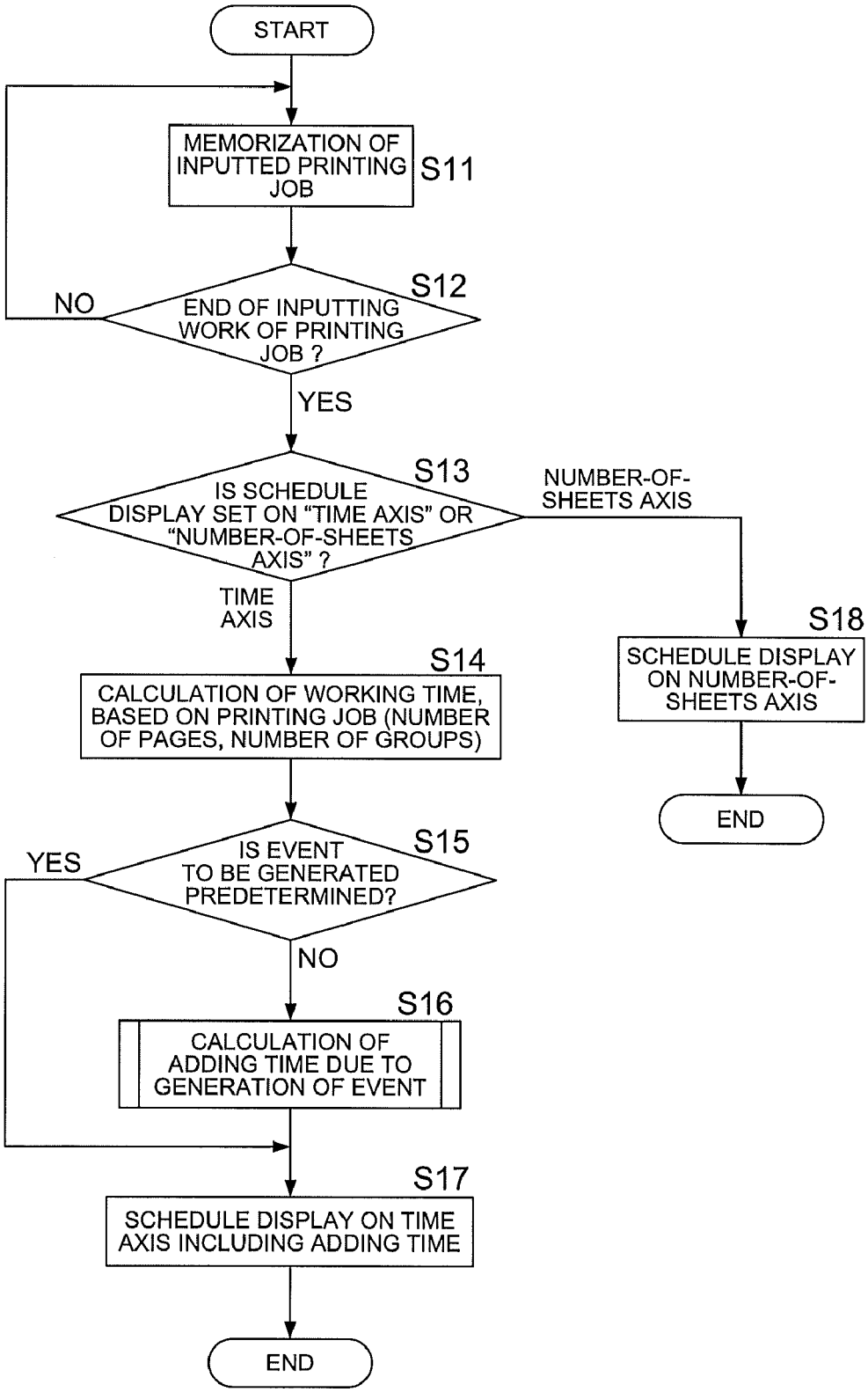
FIG. 7 is a flow chart to show the operation conducted by the image forming apparatus of the present embodiment.

FIG. 7 shows a control flow to be conducted by the image forming apparatus in the present embodiment. In step S11, inputted printing jobs are memorized in image memory C107. When all printing jobs have been completely inputted ((Yes in step S12), and if the schedule display setting has been set based on a time axis ("time axis" in step S13), the working time is calculated in step S14, based on the number of pages, the sheet supplying unit to be used, the group of sheets to be printed repeatedly, the setting of prints, such as double-surface print, and the memorized time required for a unit number of sheet, all of which are included in the printing jobs to be conducted.

Step S15 checks whether any event is generated, during a time interval from starting to ending of all printing jobs.

The events represent:

(1) events to be generated when the sheet supplying section (being the sheet supplying unit) is switched to another one, and (2) events to be generated on a predetermined cycle. These events are generated when a printing job starts, or while a printing job is conducted, which are controlled by total control section C100 of the image forming apparatus.

The events described in (1) include:

(1a) a warm-up operation in which heater he3 is activated to dehumidify the interior of the sheet supplying unit, (1b) a preliminary operation in which the suction force of the fan is stabilized, when the sheet supplying unit using the suction feeding method is to be used, and (1c) a preliminary operation to heat the fixing section.

The events described in (2) include (2a) an image density adjusting operation to adjust the density at image forming section 4.

In a case that said events are to be generated by the completion of all of the printing jobs (Yes in step S15), an adding time (being the amount of time required) due to the generation of the events is calculated in step S16. The adding time, in the case of (1a), is calculated by the detection of humidity sensor C155, as detailed above. The adding times, in the cases of (1b), (1c) and (2a), are calculated based on the corresponding table which has been memorized in non-volatile memory C106.

In step S17, either the vertical axis or the horizontal axis is determined as the time axis, in which the schedule of the printing job, including the adding time due to the generation of the events, is displayed on operation display section C141.

Figure 8:
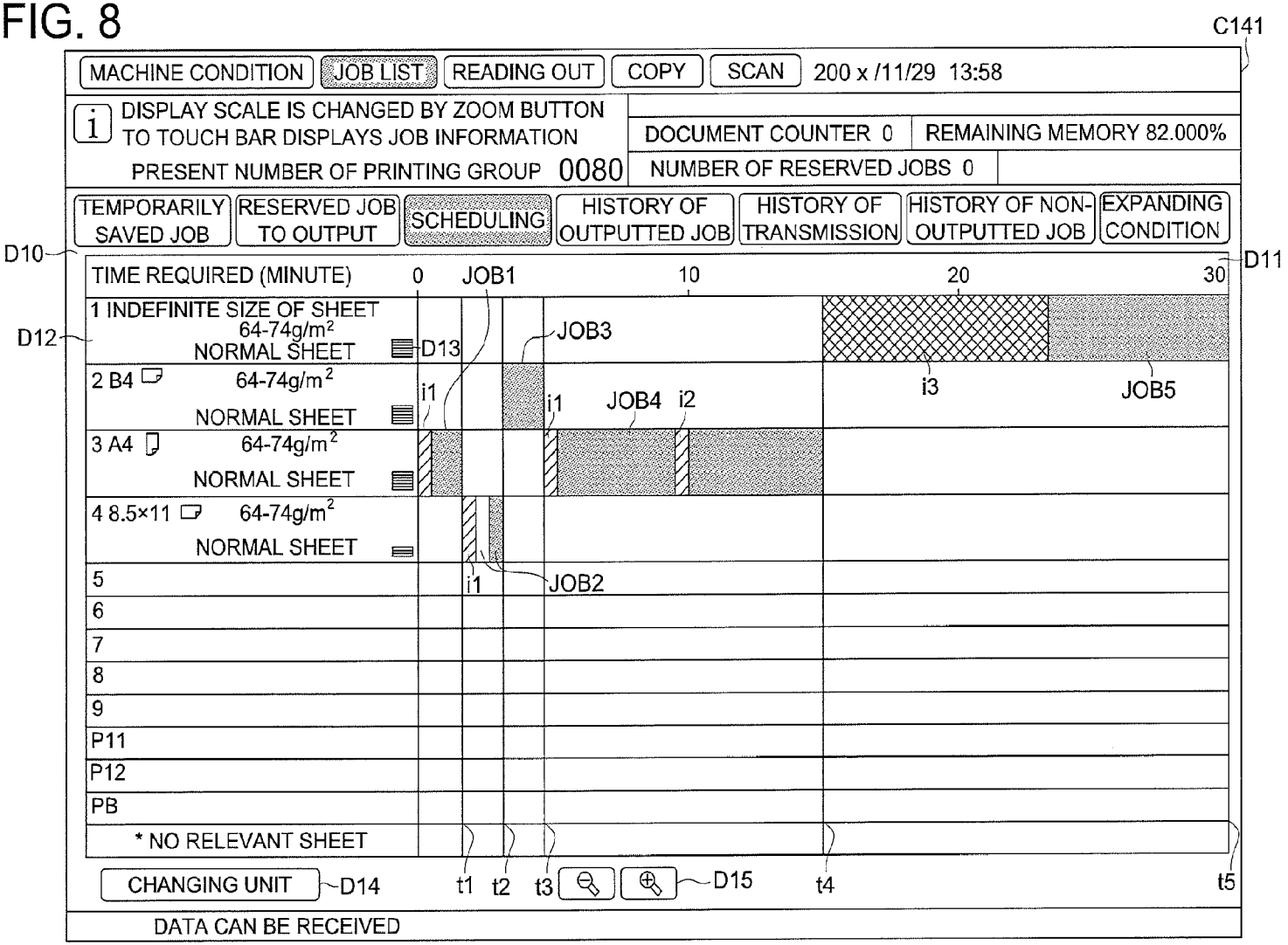
FIG. 8 is an example of a scheduling screen, displayed by operation display section C141.
Figure 9:
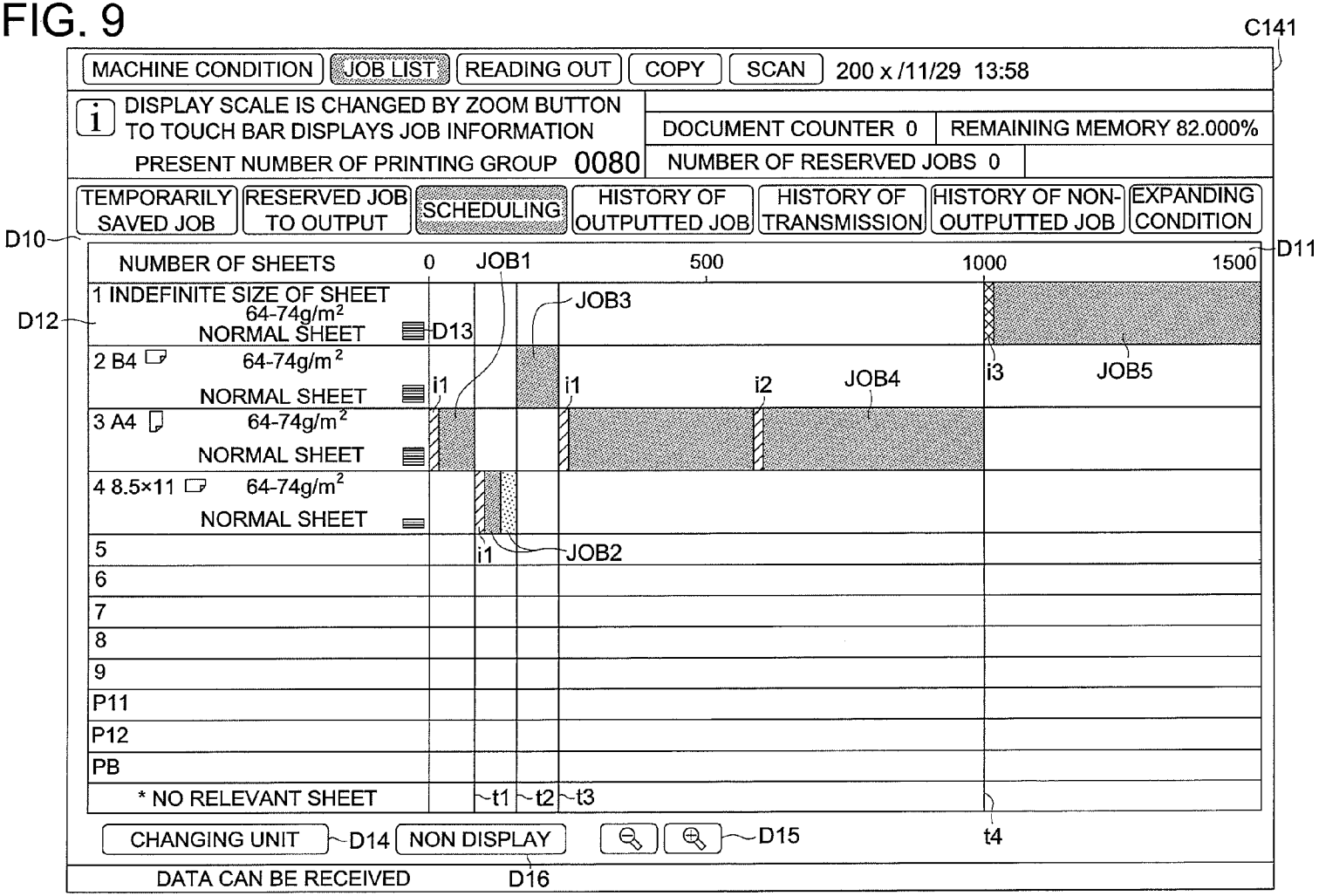
FIG. 9 is an example of a scheduling screen, displayed by operation display section C141.
Figure 10:
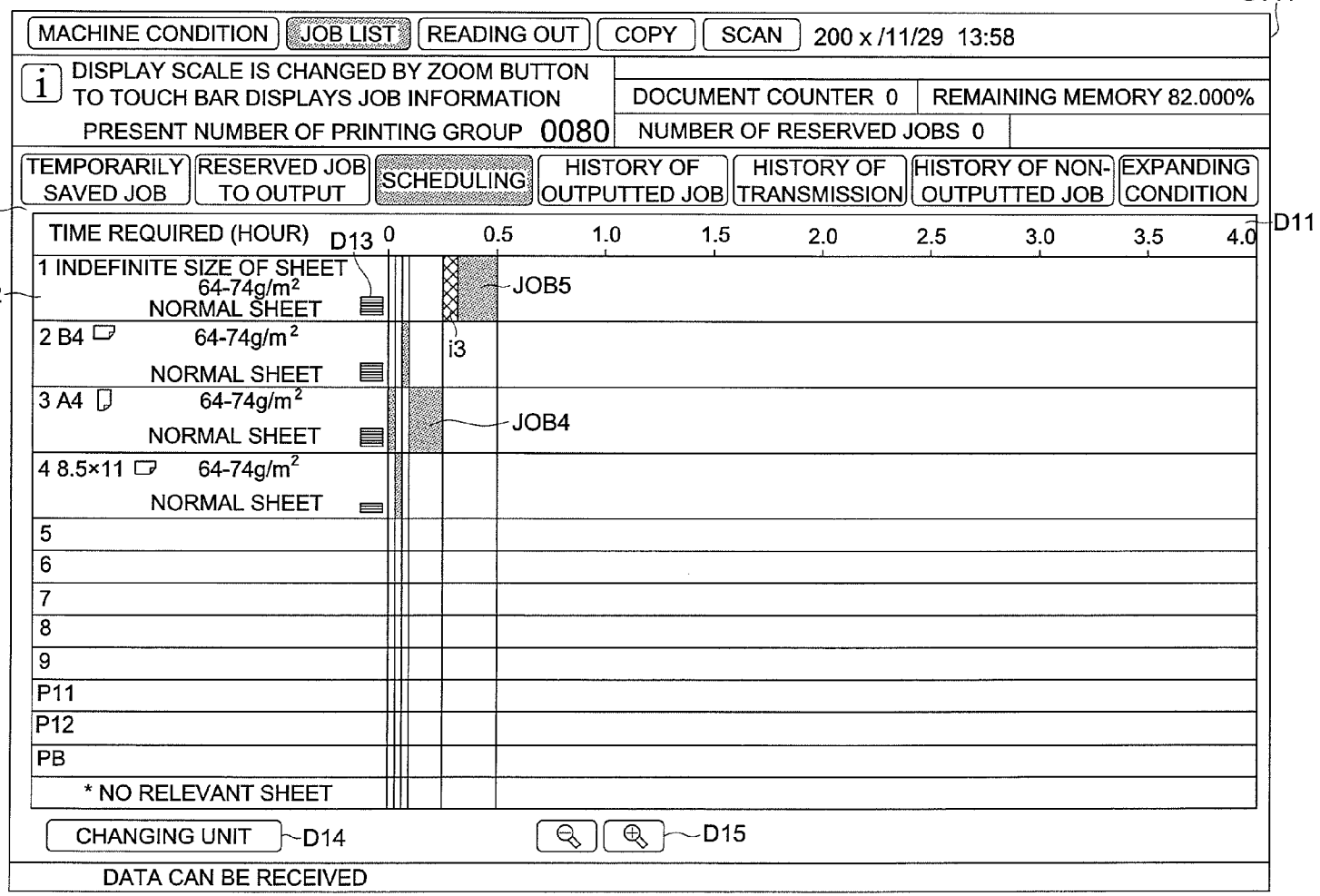
FIG. 10 is an example of a scheduling screen, displayed by operation display section C141.

FIGS. 8-10 show examples of the scheduling screens, displayed on operation display section C141. On these figures, the schedules are displayed for printing five printing jobs, JOB 1-JOB 5, whereby on schedule table D10, arranged are horizontal axis display section D11, sheet supplying unit display section D12, remaining sheet display section D13, unit changing button D14, and horizontal axis scale size changing button D15.

Further, symbols "i1"-"i3" display events. That is event "i1" shows the warm-up operation for stabilizing the suction force of the fan of event (1b), event "i2" shows image density adjusting operation (2a), and event "i3" shows preliminary operation (1a) for de-humidifying the interior of the sheet supplying unit. Still further, events "i1"-"i3" have display widths in accordance with the estimated time required (being the length in the time axial direction), to be displayed variously, while changing color, density, patching pattern, or the combination of these items, whereby the types of events can be recognized. When the operator touches each event display section, a subsidiary screen is overlapped on schedule table D10, so that various information, such as the types of the event, and the time required of the event, can be displayed.

FIGS. 8 and 10 show the scheduling screens, in which the vertical axis is shown by the time axis. FIG. 9 shows the scheduling screens, in which the vertical axis shows the number of sheets. When the operator operates unit changing button D14, the vertical axis can be switched between the time axis and the axis based on the number of sheets. FIG. 10, using "hour" in the vertical axis, shows the time axis greater than that of FIG. 8, using "minute".

Schedule table D10 is updated at the predetermined cycle, while the printing job is being executed. For example, if a new job is generated while the printing job is executed, or if the printing job is completed, or if the printing job is interrupted due to the end of sheets, the display is updated so as to display a relating conditions.

In FIGS. 8-10, the sheet supplying units are arranged on the vertical axis. However, the sheet supplying units can be arranged in accordance with each printing job. Further, the vertical axis and the horizontal axis are changed to each other based on the displaying condition. Still further, one printing job uses one sheet supplying job in this example, however, in a case of the printing job to print a large volume of sheets, it is possible to arrange the sheet supplying units in accordance with their changing order, in which the sheet supplying units to be used are changed, by an automatic changing operation, during the execution of the printing job. The automatic changing operation sequentially changes the plural sheet supplying units, each accommodating the same type of sheets, when a working sheet supplying unit becomes empty.

In FIG. 8, sheets P, accommodated in four sheet supplying unit, displayed on sheet supplying unit display section D12, are used for the execution of the printing job. Sheet supplying unit display section D12 displays information concerning plural sheet supplying units. As said information concerning plural sheet supplying units, listed are a numerical number to identify the sheet supplying unit, the size of sheet, the type of sheet, and the amount of remaining sheets. In FIG. 8, the sheet supplying unit, carrying identification numeral "1" shown on the uppermost line, includes "indefinite size of sheet" as information of the sheet size, "normal sheet" as information of the type of sheet, and "67-74 g/m$^2$" as information of the weight of sheet.

The operator understands the number of remaining sheets, when they are accommodated in the present sheet supplying unit, based on remaining number display section D13. In FIG. 8, sheet supplying unit "4" has less sheets, while sheet supplying units 1-3 have a larger number of remaining sheets. The number of remaining sheets is calculated, based on a position of sheet plate 31 to be elevated by the motor, in that said position is detected by the rotating number of the motor. In case of "NUMBER-OF-SHEETS AXIS", the flow chart goes S18.

FIG. 8 shows that during a time interval from an operation starting time to time "t1", printing job JOB 1 is executed, using the sheets accommodated in sheet supplying unit "3", and event "i1" is executed, before printing job JOB 1 is executed.

During a time interval from "t1" to "t2", printing job JOB 2 is executed, using the sheets accommodated in sheet supplying unit "4", and event "i1" is executed, before printing job JOB 2 is executed, due to the change of sheet supplying unit. Printing job JOB 2 is illustrated by two portions (or illustrated by two different colors), which teach the difference of the number of remaining sheets, in a stepwise manner.

During a time interval from "t2" to "t3", printing job JOB 3 is executed, using the sheets accommodated in sheet supplying unit "2". Said sheet supplying unit "2" supplies the sheet by a roller feeding method to separate the sheets one by one, using the friction between the sheet and the surface of the roller, which method differs from the suction method, so that event "i1" is not generated.

During a time interval from "t3" to "t4", printing job JOB 4 is executed, using the sheets accommodated in sheet supplying unit "3". For printing job JOB 4, due to the change of the sheet supplying unit, event "i1" is executed before printing job JOB 4 is executed, and event "i2", generated at the predetermined cycle, is executed, during the execution of printing job JOB 4.

During a time interval from "t4" to "t5", printing job JOB 5 is executed, using the sheets accommodated in sheet supplying unit "1". For printing job JOB 5, due to the change of the sheet supplying unit, event "i3" is executed before printing job JOBS is executed.

Based on the present embodiment, the interrupting time, which occurs due to the various events for executing the printing job, is studied, and the schedule can be displayed on the display section, whereby the scheduling operation for the printing operation is precisely conducted.

In FIG. 9, the horizontal axis of the scheduling screen of FIG. 8 is changed from the time axis to the axis of the number of sheets. Events "i1"-"i3" are displayed, but only their generating times are displayed. In an example shown in FIG. 9, the width of each event is the same, which are overlapped on each printing job. If non-display button D16 is operated, these events are switched to become visible or not for the operator.

Based on the present embodiment, though the horizontal axis is based on the number of sheets, the schedule can be displayed on the display section, while the generation time of the events are studied, whereby the scheduling operation for the printing operation is precisely conducted.

FIG. 10 shows the scheduling screen, in which the vertical axis of FIG. 8 is expanded, so that each portion is displayed, while its size is decreased. In the present embodiment, based on the size of the time axis, the display of the event is changed to be visible or not. In detail, due to the resolving power or the view ability of the display section, if an event is displayed to be less than a predetermined width in the decreased display, such the event is controlled not to be displayed.

As shown by horizontal axis display section D11 in FIG. 10, the horizontal axis is determined to be 0-4 hours, which is 8 times greater than the horizontal axis, determined to be 0-30 minutes, of FIG. 8. In FIG. 10, the predetermined width, to be the border for changing the event to be visible or not, is 1/100 of 30 minutes corresponding to a single scale of the horizontal axis in FIG. 10. That is, in the example in FIG. 10, events "i1" and "i2", being less than 18 sec, is not displayed, while event "i3" is displayed to be visible.

Based on the present embodiment, the interrupting time, due to the various events for conducting the printing operation, is studied, whereby the events in the schedule are displayed by the hour scale on the display section, so that the scheduling operation of the printing jobs is precisely controlled.

What is claimed is:

1. An image forming apparatus comprising:

plural sheet supplying sections which accommodate a recording sheet and feed out the recording sheet;

an image forming section which forms an image on the recording sheet, fed out from a sheet supplying section, based on a printing job;

a memory section which stores information of the printing job, including at least information of the recording sheet to be used; and a control section which determines at least a sheet supplying section to be used, based on the information of the recording sheet, included in the printing job stored in the memory section, and displays an event using a time axis provided on one of a vertical axis or a horizontal axis on a display section, wherein the event is generated by a schedule for using the sheet supplying section determined above, and is generated when the sheet supplying section to be used is switched to another sheet-supplying section, or the event is generated at a predetermined time cycle.

2. The image forming apparatus of claim 1, wherein at least one of the plural sheet supplying sections includes, a humidity sensor which detects humidity of an interior of the sheet supplying section, and a heater being energized based on the humidity detected by the humidity sensor, wherein the event, generated when the sheet supplying section to be used is switched to, represents a preliminary operation to dehumidify an interior of a switched sheet supplying section by the heater, wherein the preliminary operation is previously conducted before the recording sheet is fed out from the switched sheet supplying section.

3. The image forming apparatus of claim 1, further comprising a fixing section which has a heating section therein, and the fixing section is electrically controlled at a preset temperature, wherein the event, generated when the sheet supplying section to be used is switched, represents a preliminary operation of the fixing section to change the preset temperature.

4. The image forming apparatus of claim 1, wherein at least one of the sheet supplying sections includes a sheet feeding section working by an air feeding method which vacuums the recording sheet by a suction fan and feeds the recording sheet, wherein the event, generated when the sheet supplying section to be used is switched, represents a preliminary operation of the sheet feeding section to stabilize a suction force of the suction fan, wherein the preliminary operation is previously conducted, before the recording sheet is fed out from the switched sheet supplying section.

5. The image forming apparatus of claim 1, wherein an image forming condition of the image forming section is changeable, wherein the event, generated at the predetermined time cycle, represents an image density adjusting process, to adjust the density of the image formed by the image forming section at the predetermined time cycle.

6. The image forming apparatus of claim 1, wherein the control section displays the event, generated when the sheet supplying section is changed, or the event, generated at the predetermined time cycle, on the display section, to identify the event.

7. The image forming apparatus of claim 1, wherein a scale of the time axis displayed on the display section is changeable, wherein the control section controls a display to show the event or not, based on a size of the scale of the time axis to be displayed.

8. The image forming apparatus of claim 1, wherein a display in which the time axis is used for one of the axis, and a display in which the number of sheets is applied on the axis, are changeable to be displayed, wherein when the display, in which the number of sheets is applied on the axis, is selected, the control section displays a generating time of the event, generated when the sheet supplying section is changed, based on a schedule for showing a use of the sheet supplying section, or the control section displays a generating time of the event, generated at the predetermined time cycle.

9. The image forming apparatus of claim 1, wherein the control section is possible to change the display not to display the generating time of the event, generated when the sheet supplying section is changed, or the control section is possible to change the display not to display the generating time of the event generated at the predetermined time cycle.

* * * * *